US007442263B2

(12) United States Patent
Günther et al.

(10) Patent No.: US 7,442,263 B2
(45) **Date of Patent: *Oct. 28, 2008**

(54) MAGNETIC AMPLIFIER CHOKE (MAGAMP CHOKE) WITH A MAGNETIC CORE, USE OF MAGNETIC AMPLIFIERS AND METHOD FOR PRODUCING SOFTMAGNETIC CORES FOR MAGNETIC AMPLIFIERS

(75) Inventors: Wulf Günther, Maintal (DE); Roman Klinger, Hanau (DE); Werner Loges, Langenselbold (DE); Jörg Petzold, Bruchköbel (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 38 days.

This patent is subject to a terminal disclaimer.

(21) Appl. No.: 10/380,714

(22) PCT Filed: Sep. 7, 2001

(86) PCT No.: PCT/EP01/10362

§ 371 (c)(1),
(2), (4) Date: Jul. 22, 2003

(87) PCT Pub. No.: WO02/23560

PCT Pub. Date: Mar. 21, 2002

(65) Prior Publication Data

US 2004/0027220 A1 Feb. 12, 2004

(30) Foreign Application Priority Data

Sep. 15, 2000 (DE) ..... 100 45 705

(51) Int. Cl.
*H01F 1/147* (2006.01)
*H01F 1/153* (2006.01)

(52) U.S. Cl. ..... 148/307; 148/108; 323/355; 323/363

(58) Field of Classification Search ..... None
See application file for complete search history.

(56) References Cited

U.S. PATENT DOCUMENTS

| | | | | |
|---|---|---|---|---|
| 5,069,731 | A | 12/1991 | Yoshizawa et al. | |
| 5,611,871 | A * | 3/1997 | Yoshizawa et al. | 148/108 |
| 5,725,686 | A | 3/1998 | Yoshizawa et al. | |
| 5,804,282 | A * | 9/1998 | Watanabe et al. | 428/141 |
| 6,270,592 | B1 * | 8/2001 | Nakajima et al. | 148/306 |
| 6,507,262 | B1 * | 1/2003 | Otte et al. | 336/213 |

FOREIGN PATENT DOCUMENTS

| | | |
|---|---|---|
| DE | 19844132 | 4/1999 |
| EP | 0635853 | 1/1995 |
| EP | 0637038 | 2/1995 |
| JP | 1-247557 | 3/1989 |

OTHER PUBLICATIONS

D. Grätzer et al., "Transduktor in Schaltnetzteilen", VAC trade literature TB-410-1 Vacuumschmelze GmbH, Hanau, Germany, May 1988.

* cited by examiner

*Primary Examiner*—John P. Sheehan
(74) *Attorney, Agent, or Firm*—Buchanan & Ingersoll & Rooney PC

(57) ABSTRACT

The invention relates to a transductor regulator with a magnetic core which is made up of a nanocrystalline alloy which is almost free of magnetorestriction. The core has as low cyclic magnetization losses as possible and as rectangular a hysterisis cycle as possible. Said alloy has the composition: FeaCobCucM'dSixByM"z, M' representing an element from the group V, Nb, Ta, Ti, Mo, W, Zr, Hf or a combination of these and M" representing an element from the group C, P, Ge, As, Sb, In, O, N or a combination of these and the following conditions applying: a+b+c+d+x+y+z=100%, with a=100%−b−c−d−x−y−z, 0≦b≦15, 0.5≦c≦2, 0.1≦d≦6, 2≦x≦20, 2≦y≦18, 0≦z≦10 and x+y>18. The inventive transductor regulators are particularly advantageously used in motor vehicle voltage supplies, rail power supplies or in aircraft power supplies.

22 Claims, 7 Drawing Sheets

Heat treatment to produce z-loops in a run modular heat treatment to produce z-loops in two seperate stages FIG 4a heat treatment in a run
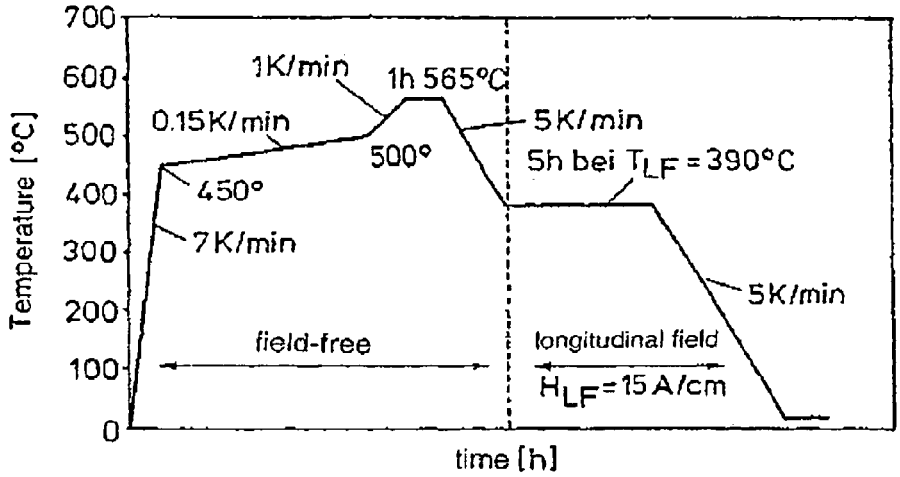
FIG 4b modular heat treatment in 2 stages
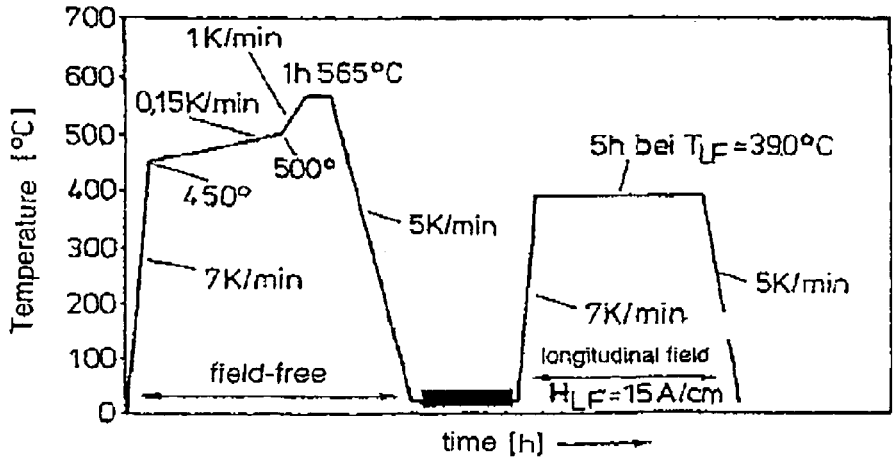

FIG 5a heat treatment in a run
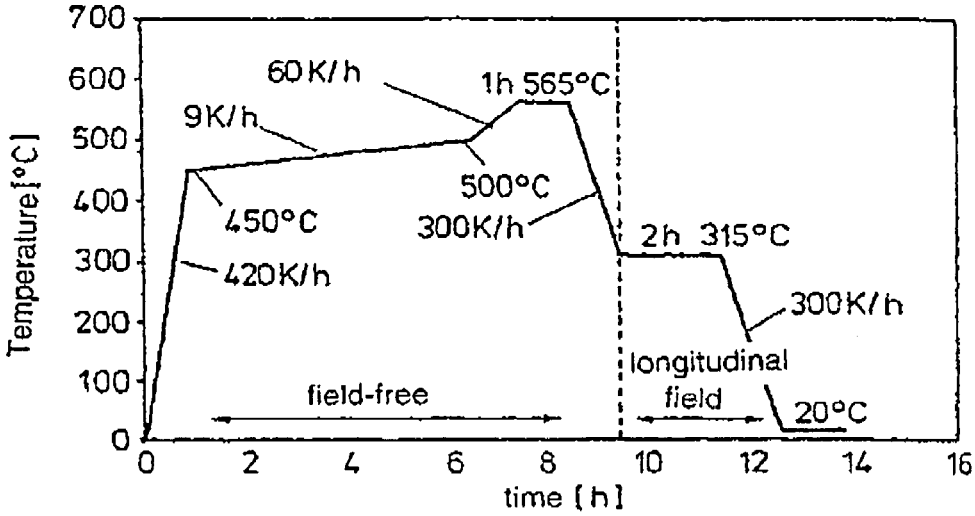
FIG 5b modular heat treatment in 2 stages
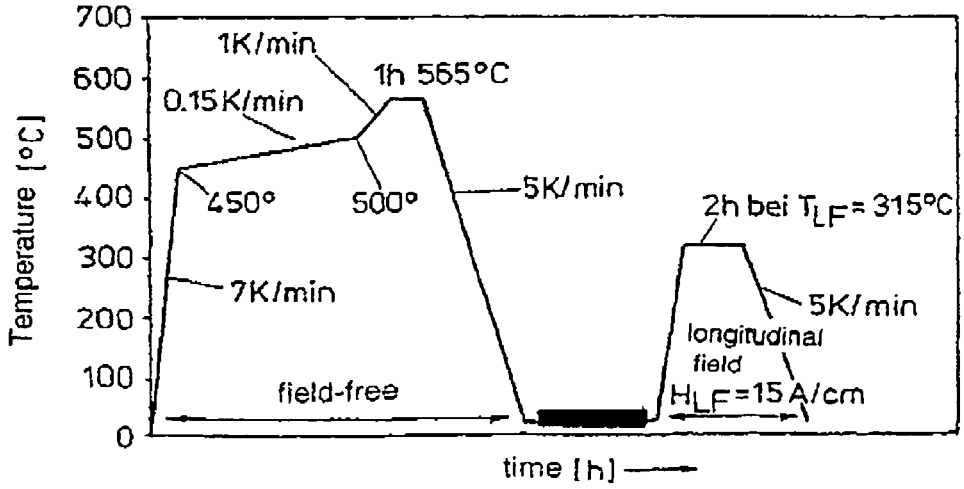

FIG 6 longitudinal field treatment for a Value of $K_u$ as high as possible
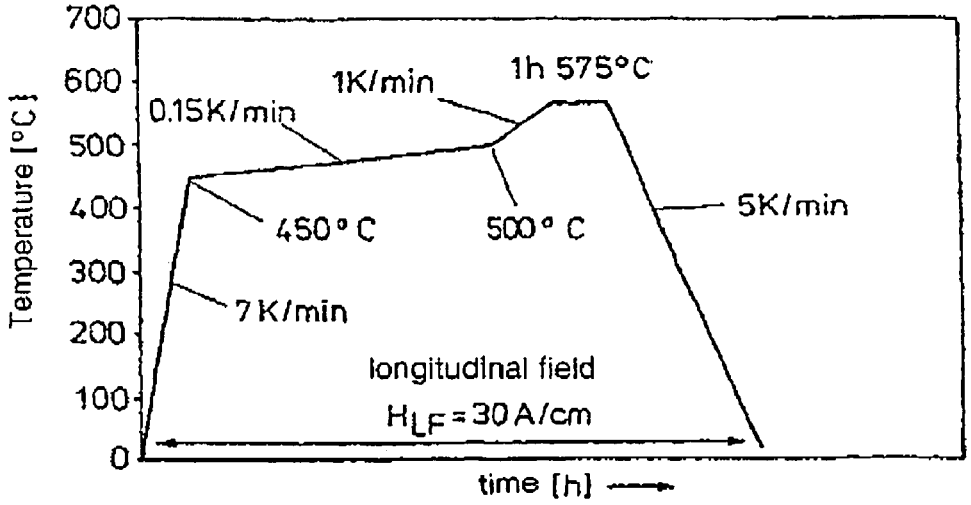
FIG 7 heat treatment for a small Ku-value. This heat treatment could be performed analogously to Fig5b in 2 stages, with or without a transversal field
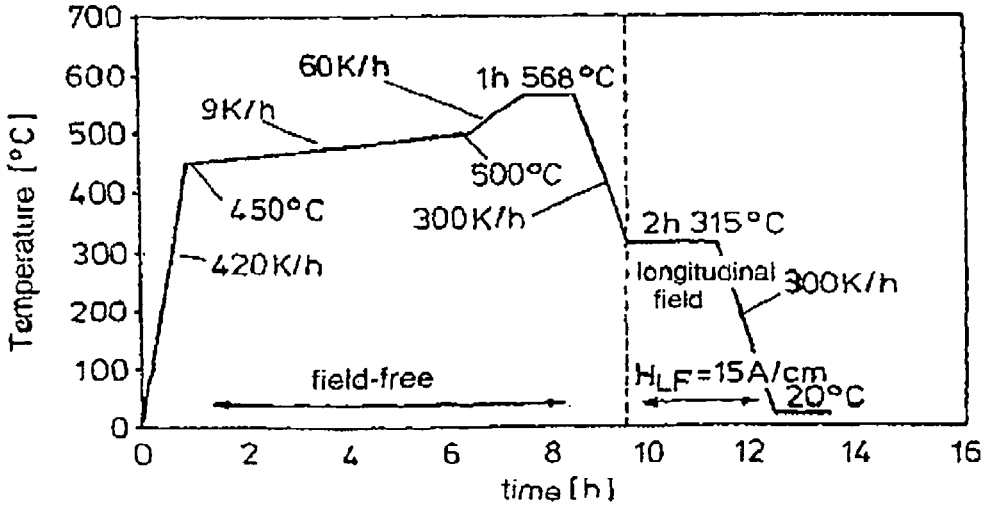

FIG 8 Heat treatment to set a small residual excursion despite incomplete adjusted magnetostriction
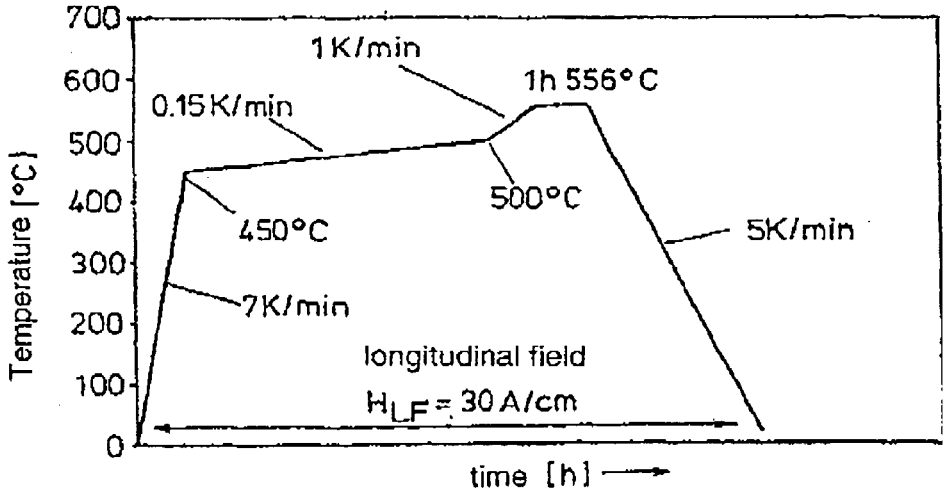
FIG 9
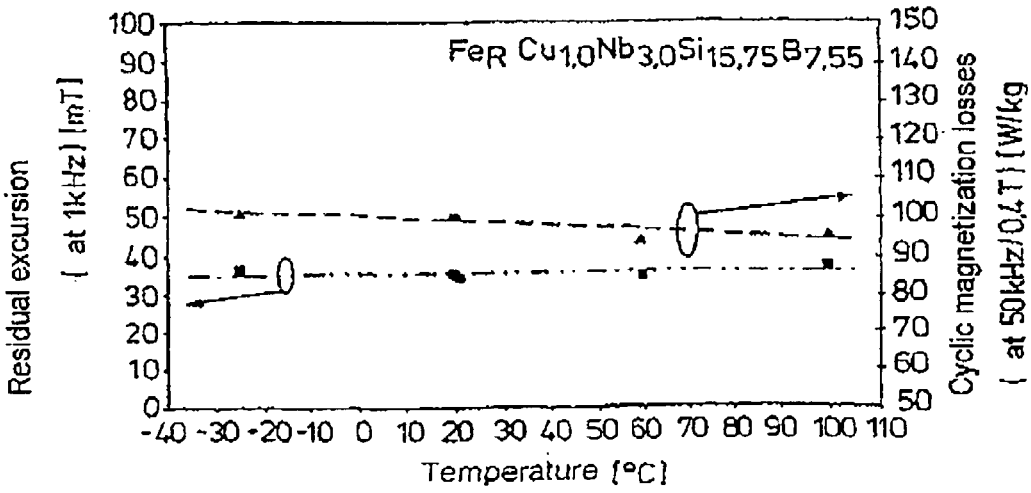

MAGNETIC AMPLIFIER CHOKE (MAGAMP CHOKE) WITH A MAGNETIC CORE, USE OF MAGNETIC AMPLIFIERS AND METHOD FOR PRODUCING SOFTMAGNETIC CORES FOR MAGNETIC AMPLIFIERS

This application claims priory to German Application No. 100 45 705.3 filed on Sep. 15, 2000 and is a 371 of International Application No. PCT/EP01/10362 filed on Sep. 7, 2001, the entire contents of which are incorporated herein by reference.

BACKGROUND

1. Field

Transductor choke with a magnetic core, use of transductor chokes and method for producing magnetic cores for transductor chokes.

The invention relates to a transductor choke with a magnetic core, the deployment of transductor chokes as well as a method for producing magnetic cores for transductor chokes.

2. Description of Related Art

Switched power supply units using transductor regulators with clock frequencies between 20 kHz and 300 kHz are being progressively more deployed in ever more diversified applications as for instance in applications, which require voltages that are adjusted exactly to a maximum of power or currents despite quick load changes. They include e.g. switched power supply units for PCs or printers.

The basic principles of this type of transductor regulator including the corresponding transductor choke and the related switched power supply units are described in detail in for instance DE 198 44 132 A1 or the VAC trade literature TB-410-1, 1988.

SUMMARY

There basically exist two requirements for a transductor regulator:

First, the windings' resistance should be as minimal as possible in order to reduce winding losses. This can be achieved by reducing the winding rate while concurrently increasing the conductor's cross-section. At the same time, this effects an increased changeover rejection of the transductor's core material and thus the magnetic reversal losses. However, a significant reduction of the transductor core volumes and thus the component volumes can only be achieved if the specific losses of the transductor's core materials are considerably reduced, or if very high magnetic reversal losses are permitted due to extremely high upper application limit temperatures.

Secondly, the so-called induction excursion $\Delta B_{RS}=B_S-B_R$ of remanence $B_R$ into saturation $B_S$ should be as negligible as possible, as the induction excursion $\Delta B_{RS}$ signifies a tension-time area that cannot be regulated. The tension-time area, which is offered to the transductor for an adjustment to a maximum of power becomes increasingly smaller due to which a large tension-time area has an increasingly stronger effect due to $\Delta B_{RS}$. Enlarging the core geometry or the core volume can compensate this. This could entail increased cyclic magnetization losses, however. Since transductor cores with a rectangular hysteresis cycle have particularly high remanence values, they are therefore particularly well suited for transductor regulators with higher operating frequencies. Such rectangular characteristics can be created if the transductor core material has a uniaxial anisotropy $K_U$ parallel to the magnetic field H, which had been created by means of the core.

The demand for switched power supply units with increasingly smaller designs is met by the use of operating frequencies, which are increasingly higher. The switching frequencies now reach several 100 kHz predominantly in switched power supply units for PCs.

These rather high switching frequencies require transductor core materials having rather low cyclic magnetization losses. The permissible operating temperature and the long-term stability of transductor regulators are very much increased through enhancing the electronic component's packing density as well as the request for a rationalization of the fans' path. These requirements become particularly critical if the transductor regulator will be used in ambient temperatures exceeding 100° C., which for instance can occur in automobile or industrial applications. The upper limit used to be 130° C. so far.

Transductor regulators are known from DE 198 44 132 A1, which had been mentioned at the beginning. They feature magnetic cores consisting of nanocrystalline alloys. It is true that the transductor regulators described in DE 198 44 132 A1 are characterized by a excellent switch rule behavior based on their small induction excursion. However, due to high losses the alloy examples that are shown in the embodiment of the invention in connection with the heat treatments for transductor cores, which are described there, indicate that they have not been optimized for a deployment with high frequencies. The maximum possible cyclic magnetization losses are even accepted. Thus, the maximum possible operating frequencies are apparently limited to 150 kHz. Furthermore, excessive losses and noises, which are created due to magnetic elastic vibrancies, can be expected.

The task of the present invention thus consists in providing a half-cycle transducer having an excellent switching behavior with operating frequencies ranging from 10 kHz to 200 kHz or higher, while having minimal cyclic magnetization losses at the same time. Furthermore, the magnetic cores used should have a rather high aging stability up to temperatures of at least 150° C. or more, and they should have a rather small magnetic core volume.

The task is solved by means of a transductor choke, or a method for producing a magnetic core for a transductor choke, or the use of such transductor choke in accordance with the embodiments disclosed herein. Further developments of the inventive concept are also disclosed herein.

A transductor choke having a magnetic core consisting of a nanocrystalline alloy, which is composed of $Fe_aCo_bCu_cM'_dSi_xB_yM''_z$, whereby M' signifies an element from the group V, Nb, Ta, Ti, Mo, W, Zr, Hf or a combination thereof, and whereby M" signifies an element from group C, P, Ge, As, Sb, In, O, N or a combination thereof, and $a+b+c+d+x+y+z=100\%$, with $a=100\%-b-c-d-x-y-z$; $0\leqq b\leqq 15$, $0.5\leqq c\leqq 2$; $0.1\leqq d\leqq 6$; $2\leqq x\leqq 20$; $2\leqq y\leqq 18$; $0\leqq z\leqq 10$ and $x+y>18$, has been provided in the invention. This alloy has a microcrystalline structure with a metallographical core of median size D<100 nm and a volumetric performance of over 30%, a hysteresis loop, which is as rectangular as possible having low cyclic magnetization losses at the same time, as well as a considerably reduced magnetostriction of $|\lambda_S|<3$ ppm following a heat treatment, which must be exactly adjusted to the respective compound. In addition, the saturation induction has a value of $B_S=1.1 \ldots 1.5$ tesla, which is a value that cannot be obtained using other alloys that do not have that amount of magnetostriction. An additional advantage of this alloy system with a rectangular loop, which has been discovered as part of the examinations, which have been performed here, are particularly favorable in the exemplary embodiment of rather weak and almost linear temperature courses of the residual excursion and cyclic magnetization losses.

BRIEF DESCRIPTION OF DRAWINGS

FIG. 4*a* is a graph that shows the temperature/time profile of a heat treatment for the alloy $Fe_{73.5}Cu_1Nb_3Si_{15.7}B_{6.8}$, as described in the first embodiment.

FIG. 4*b* is a graph that shows modular heat treatment in two stages for the alloy $Fe_{73.5}Cu_1Nb_3Si_{15.7}B_{6.8}$, as described in the first embodiment.

FIG. 5*a* is a graph that shows heat treatment in one cycle for the same alloy as FIGS. 4*a* and 4*b*, but using a reduced longitudinal field temperature to lower the cyclic magnetization losses for a shorter time, as described in the second embodiment.

FIG. 5*b* is a graph that shows the same treatment of FIG. 5*a*, but as modular heat treatment in two stages, as described in the second embodiment.

FIG. 6 is a graph that shows longitudinal field treatment for a $K_U$ value, as described in the third embodiment.

FIG. 7 is a graph that shows a heat treatment for a small $K_U$ value that could be performed analogously to the treatment of FIG. 5*b* in two stages—with or without a transverse field.

FIG. 8 is a graph that shows a heat treatment for setting a small residual excursion despite magnetostrictions that were adjusted in an incomplete manner.

FIG. 9 is a graph that shows the weak and almost linear temperature reductions of the residual excursion and cyclic magnetization losses in this alloy system, as described in the third embodiment.

DETAILED DESCRIPTION

The alloy choice in accordance with the invention is based on the knowledge that a connection, which is similar to a hyperbola, exists between cyclic magnetization losses $P_{fe}$ and the dynamic residual excursion $\Delta B_{RS}$ for certain alloy compounds.

Figure 1:
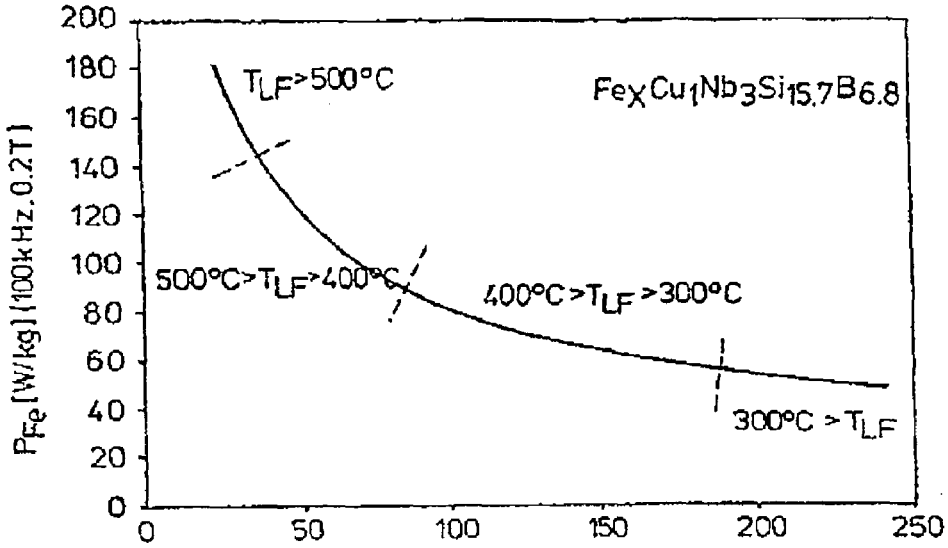
FIG. 1 is a graph that shows the connection between cyclic magnetization losses ($P_{fe}$) and the dynamic residual excursion ($\Delta B_{RS}$) using alloy $Fe_{73.5}Cu_1Nb_3Si_{15.7}B_{6.8}$.

This connection, which is similar to a hyperbola, is depicted in FIG. 1 using alloy $Fe_{73.5}Cu_1Nb_3Si_{15.7}B_{6.8}$.

The interaction of the cyclic magnetization losses $P_{fe}$ on one side and the dynamic residual excursion $\Delta B_{RS}$ on the other side will be adjusted via a heat treatment in a magnetic longitudinal field. So-called longitudinal anisotropy $K_U$ will be adjusted via such longitudinal field heat treatment, whereby $\Delta B_{RS}$ drops, while $K_U$ increases and the losses increase. The interrelationship depicted in FIG. 1 will experience interferences from interfering anisotropies. The lower the longitudinal anisotropy the greater the influence from the interfering anisotropies.

Figure 2:
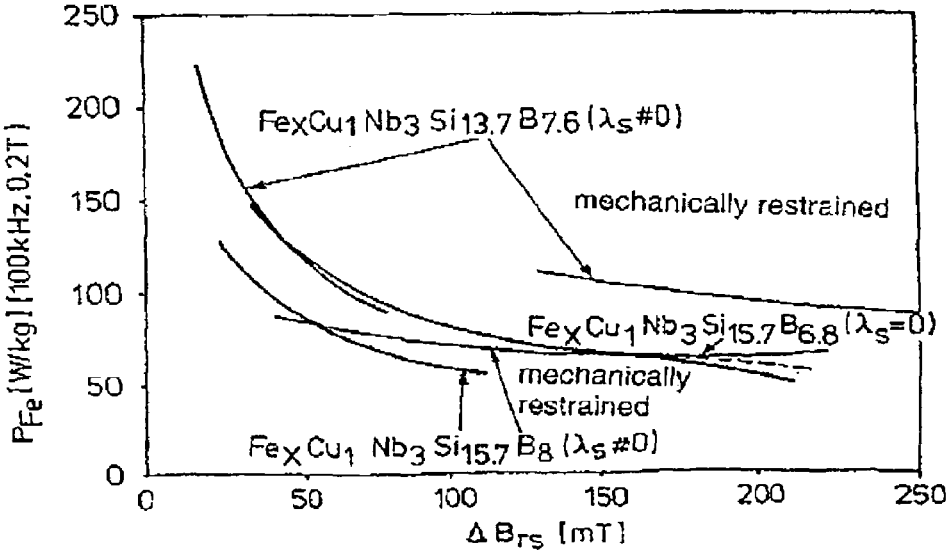
FIG. 2 is a graph that shows the influence of mechanical restraints on magnetic cores of non-adjusted magnetic strictions.

This is clearly visible in FIG. 2, which depicts the influence of mechanical restraints on magnetic cores of non-adjusted magnetostrictions.

The value of longitudinal anisotropy $K_U$ must be limited to a reasonable minimum in accordance with the present invention, since the amount of total losses, which are composed of classic eddy current losses and abnormal eddy current losses, thus notably determining self-heating and the magnetic core's upper application limit temperature via its modulation capacity as well as size at certain operational frequencies.

The aging stability of the hysteresis characteristics reduces if the values of longitudinal anisotropy $K_U$ are too low and/or the influence of the so-called magnetic elastic but also structural or interfering anisotropies, which come from the band's topology (surface roughness), increase considerably. Both interferences cause remanence $B_R$ to decrease, thus causing an increase of residual excursion $\Delta B_{RS}$, which is responsible for the dead time of the standard characteristic, whereby the static and dynamic coercive field strength increases in certain cases.

At the same time, we can fall back on the fact that the dynamic residual excursion $\Delta B_{RS}$ decreases as the frequencies increase. Nevertheless, when determining the $K_U$ value, a well-balanced and production-stable compromise between preferably low $P_{fe}$ losses on the one hand and preferably high remanences $B_R$ on the other hand should be looked for, which is possible within the nanocrystalline alloys only when selecting the above listed alloy choice in accordance with the invention.

A compromise resulting from both of these values running in opposite directions can only be set expressly by means of a heat treatment (annealing), which is adapted to the alloy's characteristics in a magnetic field, which is running along the wound band, in other words, along a so-called longitudinal field. A very rectangular hysteresis loop, a so-called Z-loop, can thus be induced.

A sufficiently low residual excursion $\Delta B_{RS}$ can be obtained in a stable manner with a small induced uniaxial anisotropy $K_U$, if the magnetic elastic part of the anisotropy in the anisotropy balance is as low as possible and the frequency as high as possible, since the stability of such a Z-loop and the height of remanence $B_R$ depends on the balance between interfering anisotropies on the one hand, and induced uniaxial anisotropy $K_U$ on the other hand.

This is largely effected by the elimination of the saturation magnetostriction $\lambda_s$, of the mechanical tensions $\sigma$ as well as crystal anisotropy $K_1$. The concurrent elimination of these three physical values, which are independent from each other, can also be effected by means of an optimized heat treatment for the alloy choice, which was listed above.

Particularly excellent characteristics with respect to the squareness of the hysteresis loop can be obtained while at the same time having only minimal cyclic magnetization losses in the magnetic cores and thus rather large modulation abilities of the transductor regulators, which were produced using theses magnetic cores, when the magnetic core has a magnetostriction value of $|\lambda_S|<0.2$ ppm and the alloy is composed of $Fe_aCo_bCu_cM'_dSi_xB_yM''_z$, whereby M' signifies an element from the group V, Nb, Ta, Ti, Mo, W, Zr, Hf or a combination thereof, and whereby M" signifies an element from the group C, P, Ge, As, Sb, In, U, N or a combination thereof, and $a+b+c+d+x+y+z=100\%$, with the following conditions: $0 \leqq b \leqq 0.5$; $0.8 \leqq c \leqq 1.2$; $2 \leqq d \leqq 4$; $14 \leqq x \leqq 17$; $5 \leqq y \leqq 12$ with $22 \leqq x+y \leqq 24$.

Surprisingly, a feature of this alloy choice, which is an alloy choice of the nanocrystalline alloy choice, which had been mentioned at the beginning, is that a markedly rectangular hysteresis loop can be realized including an optimized heat treatment using the lowest values of a uniaxial longitudinal anisotropy, which typically exists in the range $K_U \leqq 10$ J/m$^3$, due to the largest possible elimination of crystal anisotropy $K_1$ and the saturation magnetostriction $\lambda_S$.

Figure 10:
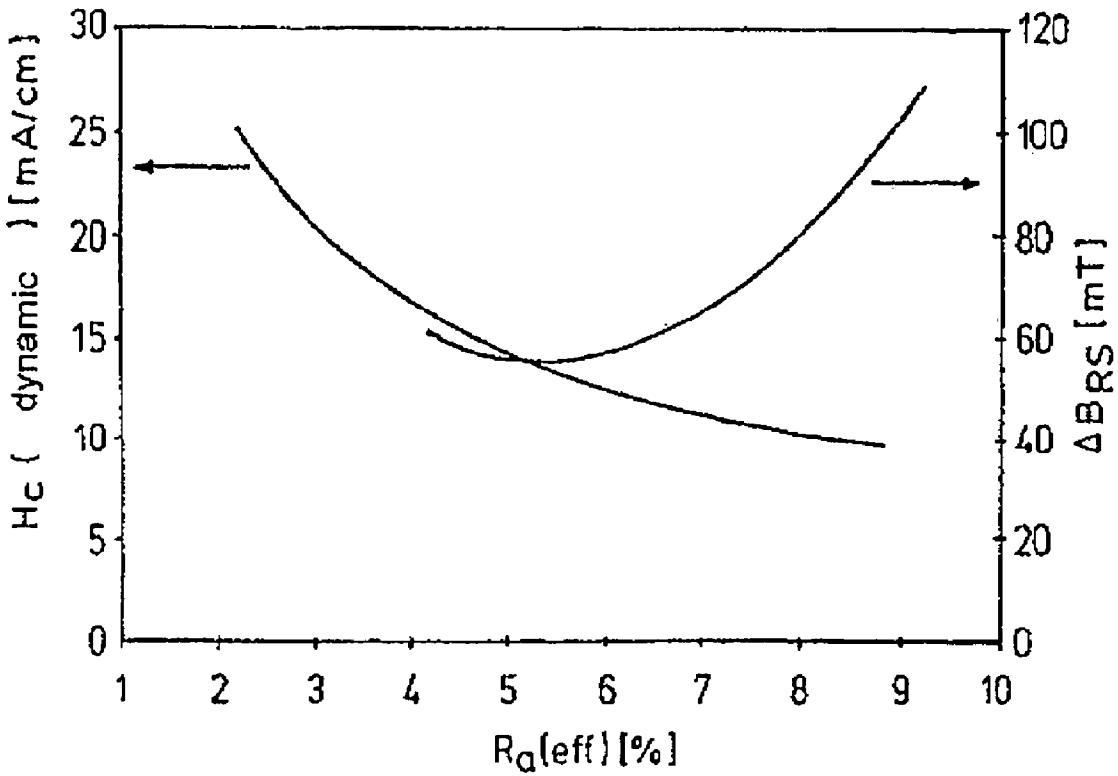
FIG. 10 is a graph that shows the connection between $H_c$ and residual excursion ($\Delta B_{RS}$) and effective roughness $R_a$ (eff).

Particularly excellent residual excursion values $\Delta B_{RS}$, which exist in the range of lower $0.025 \times B_S$, can be obtained as long as the used alloy bands feature an effective roughness, which are within the ranges listed below. The roughnesses of the surfaces as well as the band thickness are important influential values for the magnetic characteristics. The effective roughness $R_a$ (eff) is a significant influential value. Roughness $R_a$ (eff) is defined as the sum of the roughnesses, which runs transversally to the direction of the band on the band's top side and the band's bottom side divided by the band's thickness. It is thus indicated in percent. Particularly excellent residual excursions can be obtained with the alloys, which consist of the alloys, which have been listed above, and which have roughnesses ranging from 3% to 9%, and preferably from 4% to 7%, which can be inferred from FIG. 10.

The processing of the alloy bands into magnetic cores largely occurs without tension by winding them onto special machines, which are known from prior art. Typically special care is taken with respect to the mechanical freedom from stress due to the heavy requirements with respect to low losses and a pronounced squareness of the hysteresis loop of the magnetic cores.

The alloy bands are subsequently wound into magnetic cores, which typically exist as closed ring cores without air gaps. The alloy band can initially be wound in a round manner to the ring core and shaped according to the requirements by means of suitable shaping tools during the heat treatment to produce these magnetic core forms.

The appropriate shape can already be obtained during the winding phase by using suitable winding bodies.

To avoid tensions when winding the alloy band to the magnetic core, attention is preferably paid to the tensile load of the alloy band, so that it continually decreases while the band layer amount increases. Is it thus achieved that the torque, which is tangentially affecting the magnetic core, will remain constant across the entire radius of the magnetic core and that it will not increase while the radius is growing.

Particularly small static and/or dynamic coercive field strengths and thus particularly favorable loss values are obtained while having a small residual excursion at the same time, when the alloy band is equipped with an electrically isolating layer at one surface at least. This causes an improved tension release of the magnetic core on the one hand, and particularly low eddy current losses are being obtained on the other hand.

The magnetically soft amorphous band, which was produced using the quick set technology, typically features a thickness of d<30 μm, preferably <20 μm, and better <17 μm.

An immersion, traversing, spray or electrolysis process is used at the band according to the requirements with respect to the quality of the insulation layer. The same can be obtained through an immersing insulation of the wound or stacked magnetic core. When selecting the insulating medium attention needs to be paid to it properly adhering to the band's surface and that it will not cause any surface reactions, which could lead to damaged magnetic characteristics. Oxides, acrylates, phosphates, silicates and chromates of the elements Ca, Mg, Al, Ti, Zr, Hf, Si have proven themselves as effective and compatible insulators for the alloys, which are used in accordance with the invention. Mg is particularly effective. It is being applied onto the band's surface as a liquid preliminary product containing magnesium. During a special heat treatment, which does not affect the alloy, it transforms itself into a thick layer of MgO with a thickness ranging between 50 nm and 1 μm.

In order to adjust the nanocrystalline structure, magnetic cores and alloys, which are suitable for nanocrystallization, are generally subjected to an exactly adjusted crystallization heat treatment, which ranges from 450° C. to 690° C. according to the various alloy compounds. Typical dwell times range from 4 minutes to 8 hours.

This crystallization heat treatment is to be performed in a vacuum or in a passive or reducing blanket gas according to the alloy. Material-specific pureness conditions need to be adhered to in all cases, which can be brought about according to the specific cases by using the appropriate devices such as element-specific absorber or getter materials.

An exactly adjusted temperature and time combination is taken advantage of so that the alloy compounds used here exactly balance the magnetostriction contributions of the microcrystalline grain and the amorphous remaining phase thus creating the required magnetostriction variability of approximately $|\lambda_S|<3$ ppm, preferably $|\lambda_S|<0.2$ ppm.

Tempering takes place either field-free or in the magnetic field along the direction of the wound band ("longitudinal field") or transversally to it ("transverse field") according to the alloy and the embodiment of the magnetic core. A combination consisting of two or even three of these magnetic field constellations can be used in a time sequence or in a parallel manner in certain cases.

Figure 3A:
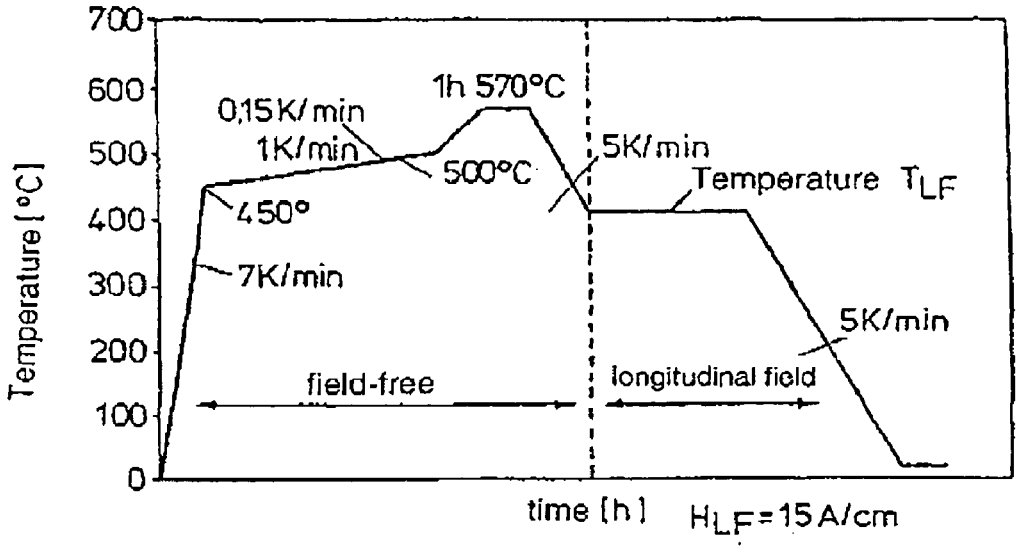
FIG. 3*a* is a graph that shows the temperature/time profile of a heat treatment for the production of Z-loops in one cycle for the alloy $Fe_{73.5}Cu_1Nb_3Si_{15.7}B_{6.8}$.

The temperature/time profile of a heat treatment, which is used for the alloy $Fe_{73.5}Cu_1Nb_3Si_{15.7}B_{6.8}$ with which the adjustment of almost complete magnetostriction variability could be obtained, is depicted in FIG. 3*a*. The initial heating rate of 7 K/min shown in this figure can be varied in almost any way ranging from approximately 1 to an excess of 20 K/min. For economic reasons, a heating rate is selected which is as high as possible, yet still feasible from a production-technological point of view.

The significant delay of the heating rate, which is shown starting at 450° C., and which is incidentally depending on the core's volume and which typically ranges approximately from 0.1 to approximately 1 K/min, serves as a temperature compensation of the nanocrystallization that was used there. Furthermore, a heating break of several minutes can be taken.

The nanocrystalline structure matures at a plateau of approx. 570° C. until the crystal grains reach a volumetric content in the amorphous remaining phase in which the magnetostriction has a "zero-crossing". Fluctuations of the alloy's silicon content can be compensated through a variation of this maturation temperature.

Thus, for instance $\lambda_S=0$ is obtained with a silicon content of 15.7 atom % at approximately 570° C. This occurs at approximately 562° C. with a silicon content of 16.0 atom %, and at 556° C. with a silicon content of 16.5 atom %.

Higher silicon contents promote the band's embrittlement. The maturation temperature must be changed to 580° C. or higher in case of lower silicon contents, e.g. a content of 15.4 atom %, whereby however harmful iron boride phases develop, which increase the coercive field strength as well as the dynamic residual excursion $\Delta B_{RS}$ at the same time.

The range of the dwell time can be varied more or less widely according to the temperature situation. Typical intervals range from 15 minutes to 2 hours at 570° C. They can be extended at lower temperatures. A high degree of maturation of the nanocrystalline two-phase structure can be achieved with shorter times, e.g. a time of 5 minutes, at higher temperatures or for rather small magnetic cores.

The influence of cooling rates is rather minor, whereby constant and preferably high cooling rates are preferred. However, the prerequisite is a defined process of the cooling phase, which continues to remain the same. For instance, cooling rates ranging from approximately 1 K/min to approximately 20 K/min have proven to be suitable. Possible influences can be compensated by means of a minor correction of the longitudinal field temperature. This is mainly the case when the crystal heat treatment is performed in a set up magnetic transverse field, and not in a field-free condition. When using a set up magnetic transverse field during the crystallization pre-treatment, the longitudinal anisotropy $K_U$ can be adjusted with great exactitude during the subsequent longitudinal field phase so that the dynamic residual excursion $\Delta B_{RS}$ and the cyclic magnetization losses $P_{fe}$ can be adjusted most precisely. In addition, the possibility of diffusions during the annealing of the stacked magnetic cores is significantly reduced.

The uniaxial longitudinal anisotropy $K_U$ is adjusted in the longitudinal field plateau. The size of the induced uniaxial longitudinal anisotropy could be adjusted over a wide range by means of the field temperature level but also the duration of the field heat treatment and the strength of the set up magnetic field as could be determined with the invention, upon which this is based. A high longitudinal field temperature $T_{LP}$ leads to a large $K_U$, which means to small dynamic residual excursions $\Delta B_{RS}$. A low longitudinal field temperature causes the opposite to occur. The exact interrelation can be deduced from FIG. 1, which had been mentioned at the beginning.

The influence of the holding period above certain times is rather minor while the temperature influencing $K_U$ is heavily dependent on kinetics.

Furthermore, the level of $K_U$ is being influenced by the strength of the longitudinal field, whereby $K_U$ steadily increases together with the longitudinal field strength. The requirement for the production of a "good" rectangular Z-loop having a small coercive field strength and a high remanence at the same time is that the magnet core is magnetized while being tempered at every place until the point of saturation induction. Longitudinal field strengths of approximately 10 to approximately 20 A/cm are typical in this case, whereby field strength H, which is necessary to reach the saturation, increases the more the geometrical quality of the deployed band is inhomogeneous. However, satisfying Z-loops can be obtained with longitudinal field strength of 5 A/cm or less. Static remanences with respect to saturation ratios of $B_R/B_S$>60% exist in case of a disappearing longitudinal field, which rapidly increase with an increasing frequency. As a result, lower losses in combination with small residual excursions can be obtained with high frequencies in this case as well, e.g. 100 kHZ or more.

Figure 3B:
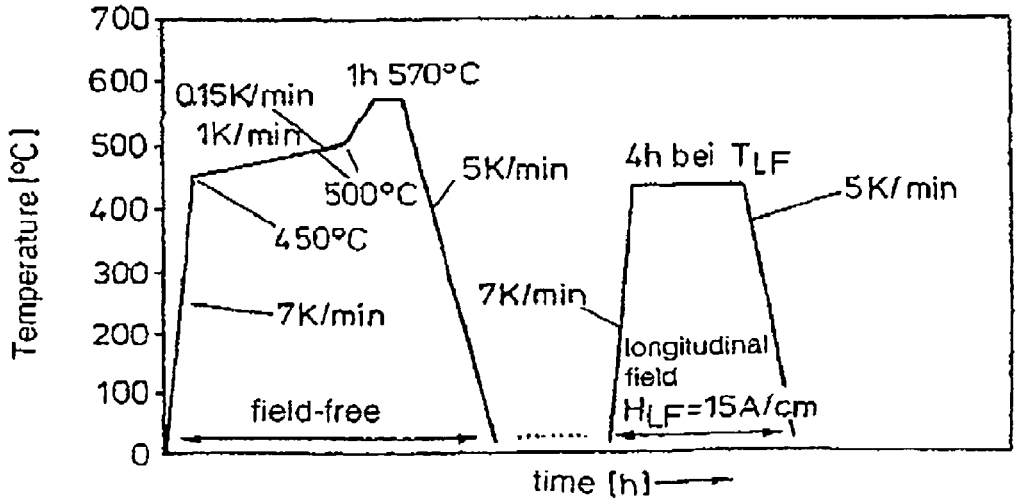
FIG. 3*b* is a graph that shows modular heat treatment for the production of Z-loops in 2 separate stages for the alloy $Fe_{73.5}Cu_1Nb_3Si_{15.7}B_{6.8}$.

Part of the present invention is to perform two subsequent heat treatments. This is depicted in FIG. 3*b*, which shows two subsequent heat treatments and their effect analogously to the heat treatment, which is depicted in FIG. 3*a*. FIGS. 3*a* and 3*b* both refer to the same alloy. The first heat treatment serves to form the actual nanocrystalline alloy having nanocrystalline grains of <100 nm and a volumetric performance of more than 30%. The second heat treatment occurs in the "longitudinal field". This second heat treatment can take place at a lower temperature as the first heat treatment and serves to form the anisotropy axis along the band's direction. As an alternative thereto, a nanocrystalline alloy structure is initially formed in one and the same heat treatment and the anisotropy axis is subsequently induced along the direction of the alloy band (see FIG. 3*a*).

In addition thereto, the anisotropy area can also be expanded and fine-tuned using a well-defined sequence of a field-free treatment and/or a treatment in the field which is adapted to the respective alloy compound, and which at times can stand along the direction of the controlled band or transversally thereto.

The production of the nanocrystalline phase and the formation of the anisotropy axis can take place at the same time if special aging-stable rectangular loops with an almost ideal remanence, i.e. $\Delta B_{RS}$ are required. The magnetic core will be heated until it reaches the targeted temperature for this purpose. It will be kept at that temperature until the nanocrystalline structure is formed, and it will subsequently be cooled until it reaches ambient temperature. The longitudinal field is either set up during the entire heat treatment or only after reaching the target temperature, or it can even be activated at a later point in time according to the targeted level of the longitudinal anisotropy. High $K_U$ values are obtained altogether when using this type of field heat treatment, which lead to comparatively large ratios of abnormal eddy current losses, which is why transductors that were made in such manner are preferably suitable for lower frequencies.

The heating up to the target temperature occurs as quickly as possible, e.g. with a rate ranging from 1° C./min to 15° C./min.

A delayed heating rate of less than 1° C./min or even a "temperature plateau" lasting several minutes can be introduced to obtain an internal temperature compensation in the magnetic core, but also a particularly fine and dense core structure in and/or below the temperature range of the starting crystallization, i.e. below the crystallization temperature, starting at 460° C., for instance.

The magnetic core will for instance be kept between 4 minutes and 8 hours at the target temperature around 550° C. in order to obtain a grain which is as small as possible and having a homogenous grain size distribution and small intergranular distances. The lower the alloy's silicon content, the higher the temperature selected. For example, the beginnings of a formation of non-magnetic iron-boride phases or the growth of surface crystallites on the band's surface constitute the upper limit for the target temperature.

The magnetic core will then be held between 3.1 and 8 hours below Curie temperature $T_C$, i.e. e.g. between 260° C. and 590° C., with an actuated longitudinal magnetic field to adjust the anisotropy axis and thus the hysteresis loop, which is as rectangular as possible. Uniaxial anisotropy $K_U$ along the band's direction, which was induced in this connection, increases the higher the temperature level in the longitudinal field is selected. The residual excursion $\Delta B_{RS}$ continually decreases due to the increased remanence, so that the highest values are created at the lowest temperatures. The cyclic magnetization losses increase inversely. The magnetic core is subsequently being cooled at a rate between 0.1° C./min and 20° C./min to ambient temperature, near temperatures of, e.g., 25° C. or 50° C. in the adjacent longitudinal field. On the one hand this is advantageous for economical reasons, and, on the other hand, for reasons of the hysteresis loop's stability, no field-free cooling may take place below the Curie temperature.

The field strength of the magnetic field, the longitudinal field, which was set up in the direction of the wound alloy band, was selected in such manner that it is significantly larger than the field strength which is required to reach saturation induction $B_S$ in this direction of the magnetic core. For instance, excellent results could already be obtained using magnetic fields H>0.9 kA/m, whereby it became known here that the induced anisotropy continually increases with the longitudinal field.

The magnetic core is solidified following the heat treatment. According to the available volume, thermal conditions or mechanical stress susceptibility the magnetic core may, for instance, be provided by means of impregnation, coating, or covering, with suitable plastic materials such as hard epoxy layers or soft xylilene layer and subsequently encapsulated. Transductor cores, which were produced in this manner, can be equipped with at least one winding, respectively. The deployment of soft and volume-saving fasteners will be enabled, despite heavy wire strengths, by means of the freedom from magnetostriction which exists to a large degree in the alloy areas, which have been indicated as being preferred.

The invention shall be discussed in detail below with respect to several embodiments. The various heat treatments, which are discussed in the embodiments, will be illustrated by means of the attached figures.

First Embodiment

Particularly excellent physical results were obtained using a magnetic core, which was wound tension-free, with the dimensions 30×20×10 $mm^3$ from the alloy $Fe_{73.42}Cu_{0.99}Nb_{2.98}Si_{15.76}B_{6.85}$, whereby the effective roughness $R_a$ (eff) of the band's surface was 4.5%. The mean band thickness was 20.7 μm.

FIGS. 4*a* and 4*b* show the temperature/time profile of the deployed heat treatments. The magnetic cores were initially heated to a temperature of approximately 450° C. using a heating rate of 7 K/min. No magnetic field had been set up. The heating rate was subsequently delayed to approximately 0.15 K/min in order to avoid an undefined overheating of the magnetic core due to an exothermal heat development during the nanocrystallization process, which begins at that point. It was heated up to a temperature of approximately 500° C. using this relatively low heating rate of 0.15 K/min. Using a heating rate of 1 K/min it was heated to a final temperature plateau of 565° C.

The magnetic core was kept at this temperature of 565° C. for approximately 1 hour. The alloy structure matured at this temperature plateau until the crystalline grains had reached a volumetric share in the amorphous alloy matrix in which the magnetostriction had almost disappeared. A subsequent cooling took place to a temperature of approximately 390° C. using a cooling rate of approximately 5 K/min. A magnetic longitudinal field $H_{LF}$ of approximately 15 A/cm was enabled. The magnetic core was left for 5 hours at this temperature in this so-called longitudinal field plateau. This set the uniaxial longitudinal anisotropy $K_U$. The magnetic core was subsequently cooled to ambient temperature using a cooling rate of 5 K/min. FIG. 4*b* depicts the heat treatment in a "modular" manner, which was just discussed, i.e. the fieldless crystallization treatment and the heat treatment in the magnetic longitudinal field were divided with respect to time, whereby the magnetic core was cooled to ambient temperature following the crystallization heat treatment.

The magnetic core showed magnetostriction $\lambda_s$=0.12 ppm after the 60 minute heat treatment at a temperature of approximately 565° C., which virtually means freedom from magnetostriction. A longitudinal anisotropy, which occurred after a subsequent five hour treatment at $T_{LP}$=390° C. in a longitudinal field with a strength of 1.5 kA/m, caused an inductive residual excursion $\Delta B_{RS}$=63 mT having cyclic magnetization losses of $P_{fe}$=85 watt/kg (measured using a frequency of 50 kHz and a magnetic field of 0.4 T).

The magnetic core's magnetic values deteriorated due to its almost perfectly adjusted magnetostriction and an insulation using magnesium oxide, which was unilaterally applied to the band's bottom part, but they did not deteriorate following a coating using a volume-saving and heat eliminating fluidized epoxy bed. This magnetic core was wound using a copper wire with a strength of 4×0.8 mm using 6 windings.

A combinational power supply unit, which was clocked at 120 kHz with a 275 watt output showed a completely stable output voltage at the transductor-regulated 3.3 volt output in this transductor element with a maximum taking up of power of 150 watt of the directly regulated 5 volt output.

A somewhat smaller, but otherwise identical magnetic core having the dimension 20×12.5×8 was installed in said switched power supply unit under a 20-watt load at the 3.3 volt output. However, the magnetic core in the transductor overheated excessively since it was driven to full output too powerfully through the tension/time area, which was too high, due to its iron cross-section, which was reduced by the factor 1.7. Thus, the switched power supply unit was not able to function at full capacity.

Second Embodiment

A magnetic core consisting of the same alloy compound and the same dimensions as in the first embodiment, and which was wound tension-free was used. However, a reduced longitudinal field temperature of approximately 315° C. was used to lower the cyclic magnetization losses $P_{fe}$ for a shorter time of 2 hours. This heat treatment is shown in FIG. 5*a*. FIG. 5*b* shows the same heat treatment in modular form the main features of which were discussed in the first embodiment.

The cyclic magnetization losses $P_{fe}$, which resulted from a dwell time that had been reduced to 2 hours, and a lowered longitudinal field temperature of approximately 315° C. were only at 62 watt/kg at this point. The dynamic residual excursion $\Delta B_{RS}$, however, was increased to 137 mT. The transductor regulator's dead time, which is related thereto, was excessive thereafter, which is why the output voltage of 3.3 volt power supply unit output collapsed under a load of 10 watts while the 5 volt output, which was directly regulated and almost coasted.

Third Embodiment

The use of power barrier diodes including an increased recovery current during the transition into the locked direction enabled a well-defined increase of the coercive field strength of transductor regulators. A magnetic core consisting of the identical alloy compound as in the first embodiment and having the same dimensions was tempered to the maximum longitudinal anisotropy $K_U$ using a single phase heat treatment at a temperature of approximately 575° C. in a magnetic longitudinal field with a strength of $H_{LF}$=30 A/cm. Thus, a very small residual excursion $\Delta B_{RS}$=25 mT was obtained, whereas the cyclic magnetization losses $P_{fe}$ increased up to 160 watt/kg at 50 kHz/0.4 T. To reduce the modulation while maintaining the tension/time area, the transductor core had to be enlarged to a dimension of 30×20×17 $mm^3$ due to the excessive cyclic magnetization losses. The heat treatment which was applied is depicted in FIG. 6. However, independent of the recovery effect, such transductor types having a high longitudinal anisotropy and a small residual excursion are very well suited for a deployment at frequencies which are barely above the audibility range, as they occur for instance in decentralized board power supplies (and frequently as auxiliary operational converters). Transductor-regulated power supply units, of which larger quantities are required and which can be diverted from the main power supply, are conceivable for e.g., modern railway technology, but above all, in airplanes. In these cases, the relatively high saturation induction of nanocrystalline alloys of an excess of 1.1 T is a great advantage, as the high modulation capacity allows for a reduction of the iron cross-section and thus a reduction in the core's weight. In addition, this advantage increases due to the fact that the core can be equipped with a epoxy layer, which eliminates heat very well. Ultimately, this is only possible due to the very small level of saturation magnetostriction without the residual excursion increasing in a noteworthy manner. Moreover, the favorable course of temperatures of the alloy system, which is depicted in FIG. 9, is advantageous above all in power supply units on board of airplanes, which are exposed to severe and quick temperature changes.

Fourth Embodiment

A 30×20×10 $mm^3$ magnetic core, which was wound tension-free, consisting of an alloy $Fe_{73.31}Cu_{0.99}Nb_{2.98}Si_{15.82}B_{6.90}$ with a roughness of $R_a$ (eff) at 7.8% was used to obtain a volume-optimized transductor regulator having only minimal cyclic magnetization losses for a deployment with rather high clock frequencies, as they can be typically encountered in switched PC power supply units. The median bandwidth was at 16.9 μm.

The cyclic magnetization losses $P_{fe}$ at 50 kHz/0.4 T were comparatively low—they were at 55 watt/kg—due to the relatively high effective roughness and the band's minor thickness, which made the magnetic core applicable even at a high clock frequency of 200 kHz or more. However, the small uniaxial anisotropy $K_U$ caused certain tension sensitivity despite an existing and almost complete freedom from magnetostriction. This required a protective trough inside the case, which was associated with geometric and thermal disadvantages.

Fifth Embodiment

Due to the excellent producibility of the alloy $Fe_{74.4}Co_{1.1}Cu_1Nb_3Si_{12.5}B_8$ and the related very low effective roughnesses, tension-free wound magnetic cores were produced from this alloy with the dimensions 30×20×10 $mm^3$. The thus obtained roughness $R_a$ (eff) of the band's surface was 2.2%. The median bandwidth was 23.4 μm.

The magnetic saturation striction $\lambda_S$ which existed after the crystallization heat treatment at 556° C. was approximately 3.7 ppm, and was therefore adjusted in an incomplete manner. To set a maximum uniaxial anisotropy $K_U$ value, the magnetic core was tempered at this temperature as well in the longitudinal field in order to obtain small residual excursion values $\Delta B_{RS}$.

The result was a very low residual $\Delta B_{RS}$ excursion of 23 mT as well as cyclic magnetization losses $P_{fe}$ of 220 watt/kg at 50 kHz/0.4 T.

Moreover, excessive cyclic magnetization losses occurred at frequencies around 30 kHz and around 120 kHz, which could be traced back to magnetic-elastic resonance effects. Any magnetic cores which were produced in this manner can only be used for comparatively low frequencies, which exist outside of these magnetic-elastic resonances. An overheating of the transductors would take place causing the destruction of the transductor regulators if other operating conditions were used under these conditions.

Sixth Embodiment

Five magnetic cores consisting of the alloy $Fe_{74.5}Cu_1Nb_3Si_{14.5}B_7$ were produced analogously to the first embodiment and as in the fifth embodiment. The saturation magnetostriction $\lambda_S$ was approx. 1.8 ppm here. The magnetic core was enveloped with fast hardening plastic so that a mechanical tension could be induced. This leads to an increased dynamic residual excursion $\Delta B_{RS}$ at frequencies of <100 kHz. A residual excursion of approximately 128 mT resulted at a frequency of approximately 10 kHz. The dynamic residual excursion was only marginally increased at frequencies exceeding 100 kHz when compared to the magnetic core from the first embodiment. The same characteristic resulted particularly after the installation into the switched power supply unit from the first embodiment.

A particularly innovative deployment of transductor regulators in accordance with the present invention is in power supply units for the board networks of motor vehicles in which the board network was converted to 42 volts. These board networks generally have different voltages. In one application 12 volt/500 watt from the 42 volt/3 kilowatt supply were realized via a transductor-regulated circuit. The output was permanently short-circuit proof at an operating frequency of 50 kHz and an ambient temperature of 85° C. in the motor of an internal combustion engine. A magnetic core with the dimensions 40×25×20 $mm^3$ was used in which the plastic trough was equipped with 18 windings. It was an open design having a taping consisting of a 3×1.3 mm magnetic wire.

New drive concepts are using electric drives to make electricity. For instance, fuel cells have been under discussion for a while already. Generally water-cooled cooling-elements are used here, as the fuel cells need to be kept at approximately 60° C. to obtain an optimal degree of efficiency. These cooling systems can also be co-used for the 12 volt/42 volt supplies to reduce the weight or the construction volume. For this, a magnetic core with the dimensions 38×28×15 $mm^3$ and an excellent heat-eliminating hard epoxy sheath was used in a power supply unit having the data that were already mentioned. The magnetic core was equipped with 46 windings consisting of 2×1.3 mm magnet wire and inserted into an aluminum case. The magnetic core was equipped with an epoxy grout with good heat-eliminating qualities in the aluminum case. An excellent cooling element connection could be obtained by means of this casing/grout combination, which, however, was only made possible by means of the magnetic core in accordance with the invention, which was almost free from magnetostriction.

The attached three dimensioning examples in table form are rendering the typical dimensioning of the transductor regulators in accordance with the invention from the alloy from embodiments 1 and 2 for the discussed application circuitry. Switched computer power supply units, i.e. switched PC power supply units as well as switched server power supply units were looked at with special attention. In practice, they are generally built as single-phase flow circuits with switching frequencies ranging from 70 to 200 kHz.

Example no. 1: transductor-regulated, short-circuit proof secondary voltage U1 of a switched PC power supply unit, f=150 kHz, ambient temperature: 45° C., i.e. maximum excess temperature of the transductor regulator=75 K. The maximum pulse-duty factor $\tau$=0.5, minimum transducer output voltage: 24 V.

| Capacity | $U_2$ | $I_1$ | Magnetic core | N | $d_{cu}$ |
|---|---|---|---|---|---|
| P = 20 W | 3.3 V | 6 A | 10 × 7 × 4.5 mm ($M_{FE}$ = 1.06 g) | 13 | 0.80 mm |
| P = 33 W | 3.3 V | 10 A | 12.5 × 10 × 5 mm ($M_{FE}$ = 1.30 g) | 13 | 2 × 0.80 mm |
| P = 75 W | 5 V | 15 A | 16 × 12.5 × 6 mm ($M_{FE}$ = 2.76 g) | 15 | 3 × 0.80 mm |

Example no. 2: transductor-regulated short-circuit proof output voltage of a switched server power supply unit, f=100 kHz, ambient temperature 60° C., maximum pulse-duty factor r=0.3, minimum transducer output voltage: 23 V. 2 solutions were realized:

| Capacity | $U_1$ | $I_1$ | Magnetic core | N | $d_{cu}$ |
|---|---|---|---|---|---|
| P = 100 W | 3.3 V | 30 A | 16 × 10 × 6 mm ($M_{FE}$ = 4.32 g) | 6 | 4 × 0.80 mm |
| P = 100 W | 3.3 V | 30 A | 16 × 12.5 × 6 mm ($M_{FE}$ = 2.76 g) | 8 | 4 × 0.90 mm |

Example no. 3: transductor-regulated short-circuit proof output voltage of a switched power supply unit, f=50 kHz, ambient temperature 45° C., maximum pulse-duty factor τ=0.5, minimum transducer output voltage: 40 V.

| Capacity | $U_1$ | $I_1$ | Magnetic core | N | $d_{cu}$ |
|---|---|---|---|---|---|
| P = 220 W | 12 V | 18 A | 19 × 15 × 10 mm ($M_{FE}$ = 6.3 g) | 16 | 3 × 0.85 mm |
| P = 380 W | 12 V | 32 A | 25 × 20 × 10 mm ($M_{FE}$ = 10.4 g) | 16 | 5 × 0.90 mm |
| P = 500 W | 12 V | 42 A | 30 × 20 × 10 mm ($M_{FE}$ = 23.1 g) | 12 | 8 × 0.80 mm |

A volume-optimized transductor choke was created in accordance with the invention, which has low losses and a high saturation induction. When producing the magnetic core for a transductor, the treatments for the transverse field and/or the longitudinal field are selectively used as part of the heat treatment to adjust the functional connection between cyclic magnetization losses and the dynamic residual excursion in a dosage and combination, which was optimally adjusted to the particular application of the transductor choke.

The focal point is control of the amount of the uniaxial longitudinal isotropy with the help of a variation of the longitudinal temperature and/or an elegant combination consisting of the transversal field and longitudinal field treatment.

After a heat treatment, which will have to be exactly adjusted to the respective compound, an alloy, on which the magnetic core is based, has a microcrystalline structure with a metallographical core of, for instance, medium size D<100 nm and a volumetric performance of for instance an excess of 30%, a hysteresis loop which will be as rectangular as possible, and concurrent low cyclic magnetization losses compared to a non-tempered condition, as well as a strongly reduced magnetostriction of $|\lambda_S|<3$ ppm. Moreover, the saturation induction has a value of e.g. $B_S$=1.1-1.5 tesla (T), which cannot be obtained with other alloys which are low in magnetostriction.

An additional advantage of the present invention is the extremely weak and almost linear temperature reductions of the residual excursion and cyclic magnetization losses in this alloy system, an example of which is depicted in FIG. 9. Here, the negative temperature reduction of the cyclic magnetization losses is particularly favorable.

The excellent temperature and aging characteristics of cores which were produced in this manner allow a deployment of up to 160° C., as only minor losses occur initially, so that stronger aging can be accepted. This is contrary to the opinion which was prevailing so far, and which generally assumed an upper application limit temperature of a maximum of 130° C. for nanocrystalline alloys. For instance, a conventional transductor core, which is shown in FIG. 1, having a frequency of 100 kHz and a modulation of $B_{MAX}$=0.02 T, can have losses of $P_{fe}$>140 watt/kg. An additional loss increase as a result of ageing cannot be accepted any more in this case.

An application of such cores is made possible in transductors in general and in transductors used for an application under high operating temperatures in particular due to the a priori small losses in the present invention and thus a higher application limit temperature. Thus, for instance, transductor regulators can be realized, which are deployed in motor vehicles or industrial drives, and thus are for example affixed to the motor as part of a motor control unit. The operating temperatures are generally definitely higher due to the immediate proximity to the motor and the complete encapsulation of the motor control unit as the operating limit temperature of the cores, which were known so far, would allow. A preferred method consists of the winding of the transductor core with an electrical conductor, which is being constructed with an appropriate temperature index in accordance with DIN 172.

The invention claimed is:

1. A transductor choke for a high frequency application comprising a magnetic core made from a nanocrystalline alloy, wherein the nanocrystalline alloy consists essentially of $Fe_aCo_bCu_cM'_dSi_xB_yM''_z$, wherein M' signifies an element from the group V, Nb, Ta, Ti, Mo, W, Zr, Hf, or a combination thereof, and wherein M" signifies an element from group C, P, Ge, As, Sb, In, O, N or a combination thereof, wherein the following conditions shall apply:

$a+b+c+d+x+y+z=100\%$, with $a=100\%-b-c-d-x-y-z$;
$0 \leqq b \leqq 15$;
$0.5 \leqq c \leqq 2$;
$0.1 \leqq d \leqq 6$;
$2 \leqq x \leqq 20$;
$2 \leqq y \leqq 18$;
$0 \leqq z \leqq 10$ and
$x+y>18$;

and wherein the magnetic core has a hysteresis loop which is as rectangular as possible, a saturation magnetostriction $|\lambda_s|<3$ ppm, and an effective roughness $R_a$ (eff) ranging from 3 to 9%.

2. The transductor choke of claim 1, wherein the following conditions apply:

$0 \leqq b \leqq 0.5$,
$0.8 \leqq c \leqq 1.2$,
$2 \leqq d \leqq 4$,
$14 \leqq x \leqq 17$,
$5 \leqq y \leqq 12$, and
$22 \leqq x+y \leqq 24$.

3. The transductor choke of claim 1 wherein the saturation magnetostriction is $|\lambda_s|<0.2$ ppm.

4. The transductor choke of claim 1 wherein the effective roughness $R_a$ (eff) ranges from 4 to 7%.

5. The transductor choke of claim 1, wherein said transductor choke has cyclic magnetization losses ($P_{fe}$) of less than 140 watt/kg at a frequency of approximately 100 kHz and an induction amplitude of approximately 0.2 T.

6. A method of producing a magnetic core for a transductor choke of claim 1, comprising:

Pouring a thin band consisting of an amorphous alloy;

Tension-free winding of the thin band to form a magnetic core;

Heating of the magnetic core to a first targeted temperature, which is above the crystallization temperature of the amorphous alloy, using a heating rate ranging from 1 K/min to 20 K/min;

Keeping the magnetic core at the first targeted temperature for a duration of 8 hours or less;

Cooling the magnetic core to a second targeted temperature, which is below the Curie temperature of the amorphous alloy, with a cooling rate ranging from 1 K/min to 20 K/min;

Keeping the magnetic core at the second targeted temperature for a duration of 8 hours or less under a magnetic longitudinal field H>0.5 kA/m; and Cooling the magnetic core to ambient temperature.

7. A method of producing a magnetic core for a transductor choke of claim 1, comprising:

Pouring a thin band consisting of an amorphous alloy;

Tension-free winding of the thin band to form a magnetic core;

Heating of the magnetic core to a first targeted temperature, which is above the crystallization temperature of the amorphous alloy, using a heating rate ranging from 1 K/min to 20 K/min;

Keeping the magnetic core at the first targeted temperature for a duration of 8 hours or less;

Cooling the magnetic core to ambient temperature;

Heating the magnetic core to a second targeted temperature, which is below the Curie temperature of the alloy, and below the crystallization temperature of the amorphous alloy, with a heating rate ranging from 1 K/min to 20 K/min;

Keeping the magnetic core at the second targeted temperature for a duration of 8 hours or less under a magnetic longitudinal field H>0.5 kA/m; and Cooling the magnetic core to ambient temperature.

8. The method producing a magnetic core of claim 6 wherein the second targeted temperature ranges from 290° C. to 520° C.

9. The method of claim 6 wherein the heating of the magnetic core to the first targeted temperature, keeping the magnetic core at the first targeted temperature, and cooling the magnetic core to the second targeted temperature are performed in a field-free manner.

10. The method of claim 6, further comprising applying a transverse magnetic field during the heating the magnetic core to the first targeted temperature.

11. The method of claim 10, further comprising applying a transverse magnetic field during the keeping the magnetic core at the first targeted temperature, the cooling the magnetic core to the second targeted temperature, or both.

12. The method of claim 6 wherein the heating up to the initial targeted temperature takes place at a temperature of approximately 450° C. with a heating rate ranging from 1 K/min to 20 K/min and subsequently with a heating rate of approximately 0.15 K/min.

13. The transductor choke having a magnetic core of claim 1 in use in connection with a switched power supply unit in a motor vehicle power supply system.

14. The transductor choke of claim 1 in use in a high frequency application wherein the transductor choke provides switching behavior with frequencies ranging from 10 kHz to 200 kHz, while having minimal cyclic magnetization losses.

15. A switched power supply unit comprising the transductor choke of claim 1.

16. The switched power supply unit of claim 15, which is a switched computer power supply unit.

17. A motor vehicle power supply system comprising the transductor choke of claim 1.

18. The transductor choke of claim 15, wherein the cyclic magnetization loss $P_{fe}$ is less than 140 watt/kg at 100 kHz or the equivalent at the operating frequency.

19. The transductor choke of claim 1, wherein the nanocrystalline alloy has a residual excursion value $\Delta B_{RS}$ is less than 0.025 $B_S$.

20. The transductor choke of claim 1, wherein the nanocrystalline alloy has a uniaxial longitudinal anisotropy $K_U$<10 J/m$^3$.

21. The transductor choke of claim 1, wherein said magnetic core further comprises an electrically isolating layer disposed on at least one surface of the nanocrystalline alloy.

22. The transductor choke of claim 21, wherein the electrically insulating layer comprises an oxide, acrylate, phosphate, silicate, or chromate of the elements Ca, Mg, Al, Ti, Zr, Hf, or Si.

* * * * *

UNITED STATES PATENT AND TRADEMARK OFFICE

CERTIFICATE OF CORRECTION

PATENT NO. : 7,442,263 B2
APPLICATION NO. : 10/380714
DATED : October 28, 2008
INVENTOR(S) : Wulf Gunther et al.

It is certified that error appears in the above-identified patent and that said Letters Patent is hereby corrected as shown below:

In column 13, line 14 of the patent: change “r = 0.3” to --T = 0.3--

In column 15, line 43 of the patent: delete “producing a magnetic core”

In column 16, line 30 of the patent: change “The transductor choke of claim 15” to --The transductor choke of claim 14--

Signed and Sealed this

Second Day of June, 2009

John Doll

JOHN DOLL
*Acting Director of the United States Patent and Trademark Office*